US005120066A

United States Patent [19]

Cohen

[11] Patent Number: 5,120,066

[45] Date of Patent: Jun. 9, 1992

[54] METHOD OF PLAYING A THESAURUS GAME

[76] Inventor: Jack L. Cohen, 10 Robin Rd., Fanwood, N.J. 07023

[21] Appl. No.: 695,726

[22] Filed: May 6, 1991

Related U.S. Application Data

[63] Continuation-in-part of Ser. No. 607,865, Nov. 1, 1990, abandoned.

[51] Int. Cl.[5] ..... A63F 3/00; A63F 9/18

[52] U.S. Cl. ..... 273/258; 273/431; 273/432; 273/291

[58] Field of Search ..... 273/243, 248–254, 273/429–432, 240, 148 R, 258, 272

[56] References Cited

U.S. PATENT DOCUMENTS

| | | | |
|---|---|---|---|
| D. 41,844 | 11/1931 | Cooke . | |
| D. 57,982 | 5/1921 | Loring | D34/5 R |
| D. 223,846 | 6/1972 | Smith | D34/5 |
| 1,196,748 | 8/1916 | Smith | 273/242 |
| 1,201,100 | 10/1916 | Rice-Wray | 273/272 |
| 1,295,993 | 3/1919 | Kleissl | 273/242 |
| 1,518,306 | 12/1924 | Clegg | 273/248 |
| 3,143,348 | 8/1964 | Carsen | 273/302 |
| 3,394,935 | 7/1968 | Beauchaine | 273/240 |
| 3,594,003 | 7/1971 | Elder | 273/272 |
| 3,678,602 | 7/1972 | Alam | 273/299 |
| 3,935,651 | 2/1976 | Mankoff | 273/302 |
| 4,124,214 | 11/1978 | Pavis | 273/249 |
| 4,171,816 | 10/1979 | Hunt | 273/299 |
| 4,306,725 | 12/1981 | Sawyer | 273/302 |
| 4,854,594 | 8/1989 | Eaton | 273/249 |
| 4,932,667 | 6/1990 | Gorski | 273/249 |

FOREIGN PATENT DOCUMENTS

| | | | |
|---|---|---|---|
| 2187393 | 9/1987 | United Kingdom | 273/249 |

OTHER PUBLICATIONS

"What's The Word"—game instructions.

Blarney by Entertainment Production House, Inc., Playthings Magazine Sep. 1987, p. 23, Trivial Pursuit, Master Game-Rules of Play, Selchow & Righter, 1981.

*Primary Examiner*—Benjamin Layno

*Attorney, Agent, or Firm*—Kenneth P. Glynn

[57] ABSTRACT

This invention is directed toward an educational game apparatus which tests the player's ability to match a key word or key symbol to one or more subwords or subsymbols. The key and list of possible answers are provided on cards, where the correct answer to the match is noted on the card back. Correct answers by a player translate into moves for the player's pieces around the continuous playing path of a game board. To win the game, a player must land each of his playing pieces on individually lettered spaces of the playing path to spell out the name of the game (i.e., T, H, E, S, A, U, R, U, S). Players have the opportunity during the game to increase the number of moves awarded them by gambling on the correctness of their answers. Special rules for game play arise when a player lands on a space already occupied by an opponent.

11 Claims, 3 Drawing Sheets

METHOD OF PLAYING A THESAURUS GAME

This application is a continuation-in-part of application Ser. No. 07/607,865 filed Nov. 1, 1990 now abandoned.

BACKGROUND OF THE INVENTION

1. Field of the Invention

The present invention is directed toward an educational game apparatus which requires the players to match key words or symbols to one or more subwords or subsymbols. Correct matches by a player translate into moves for the player's pieces around a gameboard and result in the eventual achievement of the gameboard objectives.

2. Prior Art Statement

Game apparatus utilizing gameboards or card decks make common subject matter for patent applications. While the prior art teaches game boards and card decks designed to stimulate the mental faculties of the players, it does not teach the combination of both, whereby the cards exercise and expand the player's knowledge of a particular subject area and the movement of playing pieces on the gameboard, (moves being awarded for correct answers to the stimulus on the cards), requires strategic logic on the part of the player to have the playing pieces land on their final resting spaces.

Various configurations of gameboards have been patented for their designs. U.S. Pat. No. 41,844 to Cooke describes a gameboard with spokes radiating from a center circle, where the spokes intersect two additional rings of circles of larger diameter concentric to the center circle, and whereby spaces are located at these intersections. U.S. Pat. No. Des. 223,846 to Richard D. Smith, similarly describes the design of a game board comprising a plurality of line-connected circles which outline a hexagon. A design laid out in rectangular areas, so connected as to depict a pathway for movable game pieces, is described in U.S. Pat. No. 57,982 to Loring.

Some game apparatus teach the manipulation of playing pieces on a gameboard of concentric design for the sole effort of capturing an opponent's playing pieces. U.S. Pat. No. 1,196,748 to R.B. Smith describes a game where spaces on the gameboard are located at the intersection of spokes radially extending to intersect concentric circles of varying diameters and the play is governed by rules outlining the specific directions in which playing pieces may move. U.S. Pat. No. 1,295,993 to Kleissl also permits circular and radial movement of playing pieces but stands apart from the prior art because the players begin with different numbers of playing pieces and because of the variety of ways in which one player may be declared the champion.

U.S. Pat. No. 3,935,651 to Mankoff demonstrates a card game where a standard deck of playing cards bears a vocabulary word with a plurality of definition words to choose from on the front face of the card. Proper identification of the definition corresponds to a value on each card, so that once the correct definitions of vocabulary words have been chosen and the cards receive a value, the deck is then adaptable to traditional card games.

Another card game which may be played by one or more players is taught in U.S. Pat. No. 3,143,348 to Carsen, et. al. and describes cards bearing a question and a choice of answers on a front face and indicia on the back face which, when the player marks his answer by directing placement of the card in a certain group, identifies whether the player's response is correct.

U.S. Pat. No. 3,678,602 to Alam teaches the use of combining cards marked with word parts such as roots, prefixes and suffixes to create words and expand the user's vocabulary.

U.S Pat. No. 4,306,725 to Sawyer describes a deck of cards with words and their dictionary definitions printed thereon which players may use to test themselves or each other and where play progression is advanced by the spinning of a dial, the face of the dial bearing certain indicia identifying the next card to be selected.

U.S. Pat. No. 1,201,100 to Rice-Wray describes a board game designed to simulate a golf course, which uses a shuffle board method to determine the number of moves a player may advance, the object of the game being for each player to reach each 'hole' and then to select a synonym from strips bearing words for the word located at that hole.

U.S. Pat. No. 3,594,003 to Elder is directed toward an educational word association board game wherein groups of two-sided play pieces, each side bearing information related to the other side and to other play pieces in a group, are laid out on a gameboard having plural arrays of unique playing positions and wherein players must guess the associated word/symbol on the back of the play piece to attain the opportunity to score.

Most similar to the invention at hand is the game described in U.S. Pat. No. 4,171,816, to Hunt which teaches a language game apparatus comprising a field made up of rows and columns for each player, with grammatical or language categories at the top of each column, one of the categories being selected by a player by chance, that player then having to select from a store of two-sided strips, a word that matches the category heading.

United Kingdom Pat. No. GB 2,187,393 to Hann shows a word related board game that has six apex spaces. Each space has a letter thereupon that spells out the name of the game "MASTER". Hann further comprises a deck of playing cards, wherein each card has a key word and a plurality of related subwords printed thereon.

U. S. Pat. No. 4,124,214 to Pavis shows a board game utilizing a plurality of decks of playing cards, each deck being distinguishable and corresponding to various levels of difficulty in play.

U S. Pat. No. 4,854,594 to Eaton shows a timing device to limit a player's response during play on a board game and the use of a penalty/reward deck separate from other card decks.

U. S. Pat. No. 1,518,306 to Clegg shows colored playing-pieces that correspond to colored spaces on a game board, the game board having color neutral spaces positioned thereon for safe passage of game pieces that land on such spaces.

U. S. Pat. 4,932,667 to Gorski shows a game board with a plurality of apex spaces and a reciprocating game board pattern.

Finally, the unpatented game "What's the Word" discloses a word definition board game having a playing path and cards having key words and corresponding definitions, the cards being divided into differently colored decks with varying degrees of difficulty.

While only a few of the prior art inventions show more than one element of the currently claimed invention, the combination of all the prior art elements creates a substantial field of materials. Even when combined, the present invention differs in two respects: by allowing players to select the level of difficulty at each turn, and by asking players to make decisions regarding the parts of speech at each turn, thus allowing players of all competence levels to play simultaneously. Knowing that correct answers in different levels lead to different point awards which correspond to the number of moves a player may use to achieve an objective on the gameboard, a player may exercise his ability to logically manipulate the playing pieces to achieve such objectives, as well as increase his knowledge in the subject matter of the particular category at hand at the same time.

In view of this prior art, no prior invention or combination of inventions teaches, suggests or renders obvious all the elements of the now claimed invention. No prior art shows the use of the color organization, layout and substance of the game board, double sided playing pieces and cards. The unique combination of the game elements, as described below, describe an educational game that increases a player's vocabulary and provides entertainment in a manner previously not shown by prior art.

SUMMARY OF THE INVENTION

The present invention is directed toward a method of playing an educational game which tests the player's ability to match a key word or key symbol to one or more subwords or subsymbols. The key and list of possible answers are provided on cards, where the correct answer to the match is noted on the card back. Correct answers by a player translate into moves for the player's pieces around the continuous playing path of a gameboard. To win the game, a player must land each of his game pieces on individually lettered spaces of the playing path to spell out the name of the game (i.e., T-H-E-S-A-S-R-U-S). Players have the opportunity during the game to increase the number of moves awarded them by gambling on the correctness of their answers. Special rules for game play arise when a player lands on a space already occupied by an opponent.

BRIEF DESCRIPTION OF THE DRAWINGS

The invention will be more fully understood by referring to the following detailed specifications, the above specification and the claims set forth herein, when taken in connection with the drawings appended hereto, wherein:

DETAILED DESCRIPTION OF THE INVENTION

The present invention is directed toward educational game apparatus. In the preferred embodiment, the present invention is predicated on the vocabulary of the English language. The game includes a plurality of playing cards. On one side of the card is a key word with a list of subwords. Included in the list of subwords are either synonyms, antonyms, or both. On the reverse side of the card is a code telling the player which words properly correspond to the key word. Correct answers translate directly into the number of moves that an individual's game pieces may travel around the gameboard. Different levels of difficulty in word knowledge are established by the use of at least two different decks, identifiable by certain indicia, during the play of the game. Optionally, the game may be played with more than two such decks. For example, in one embodiment three decks are used. Correct answers for card problems from decks with higher degrees of difficulty result in an increased number of moves a player may take. Winning the game entails landing each of a players' pieces on designated home spaces on the gameboard.

Figure 1:
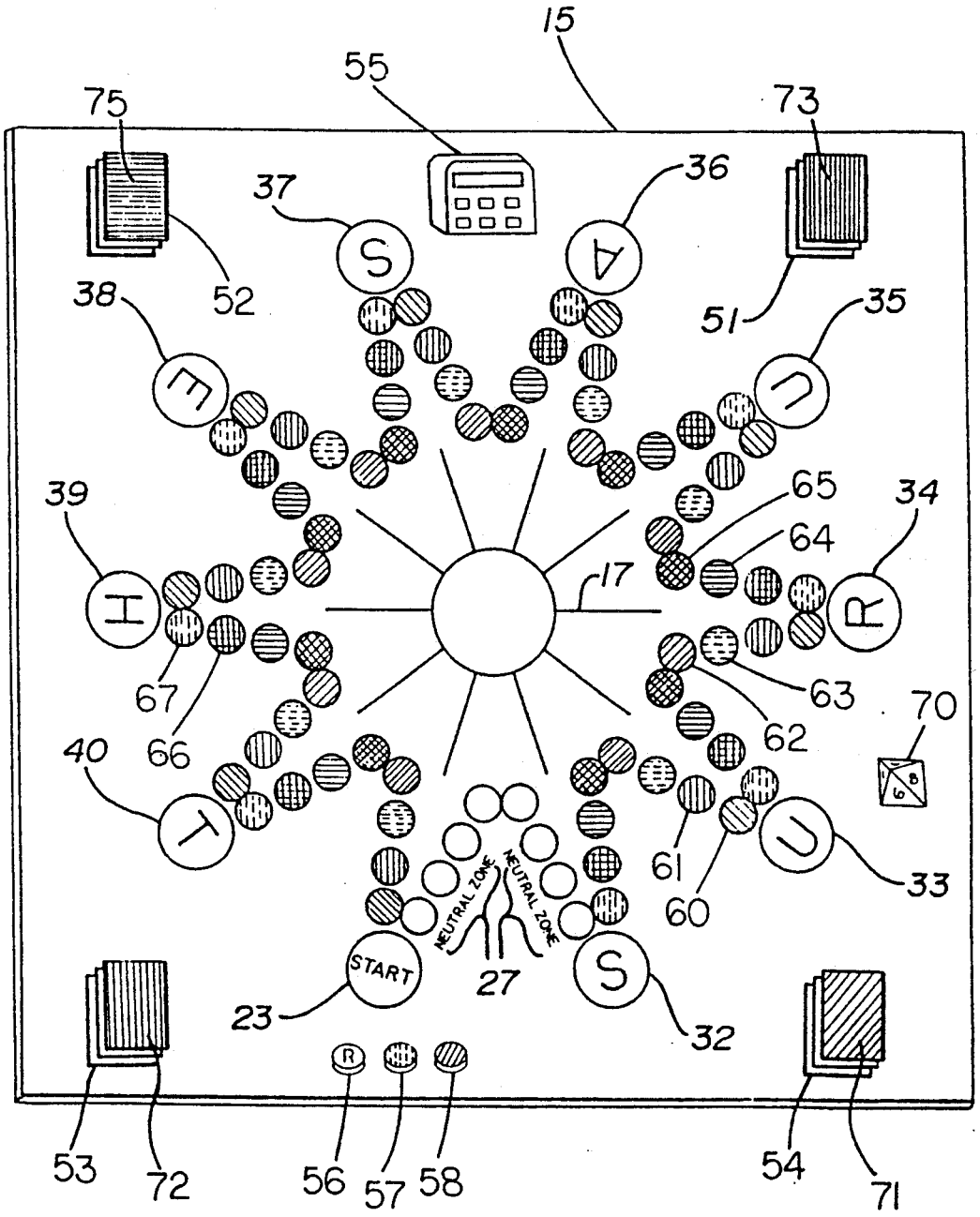
FIG. 1 shows one preferred embodiment for the game board of the present invention, with all the playing elements being present on the board.

Referring to FIG. 1, the equipment for the claimed game apparatus can best be described. The primary element of the game is the game board 15. The gameboard 15 is constructed of a durable material and has a continuous path of spaces imprinted thereon. The path on the game board 15 consists of at least five differing types of spaces, each type of space being identifiable by color or another identifying indicia. All the spaces are configured concentrically on radiating spires 17, creating a continuous reciprocating path. The apex space of one of the spires 17 is designated as the starting position 23. The other spaces located at the apex of each spire 17 are designated home spaces 32, 33, 34, 35, 36, 37, 38, 39, 40. In the preferred embodiment shown in FIG. 1, home spaces 32, 33, 34, 35, 36, 37, 38, 39, 40 are identified by individual letters marked on each home space which, when read clockwise, spell out the name of the game, "T-H-E-S-A-U-R-U-S". Between each home space 32, 33, 34, 35, 36, 37, 38, 39, 40 is a pathway of spaces. Each space between any two home spaces is a different color. In the shown embodiment the spaces follow a pattern of a green space 60, red space 61, gray space 63, brown space 62, orange space 65, blue space 64, yellow space 66 and purple space 67. This color pattern is repeated continuously between each home space 32, 33, 34, 35, 36, 37, 38, 39, 40. The color pattern is also present between the starting space 23 and the first home position 40. Located between the starting space 23 and the last home position 32 are a path of spaces 27 that have either no color, or some indicia differing from all other spaces, preferably a colored dot placed in the middle of each space 27. It should be understood that although an eight space path is shown between all home spaces 32, 33, 34, 35, 36,a 37, 38, 39, 40, any number of spaces can be used as long as the color of each varies. Similarly, the neutral space 27 between starting space 23 and the last home position 32 would complete the continuous geometric pattern created by the rest of the spaces.

Game pieces are moved around the game board 15. The game pieces come in a plurality of matched sets. There is one set of game pieces for each varied colored space between any two home spaces 32, 33, 34, 35, 36, 37, 38, 39, 40. Thus, in the present embodiment there would be eight sets of playing pieces, in compliance with the eight differing colored spaces 60, 61, 62, 63, 64, 65, 66, 67 present on the game board 15. The game pieces have two sides. On one side, the color of one set of game pieces will match the color one space 60, 61, 62, 63, 64, 65, 66, 67. As an illustration, brown game piece 58 and the purple game piece 57 represent sets of game pieces that correspond in color to brown game spaces 62 and purple game spaces 67. On the reverse side of all turned game pieces 56 is an identifying indicia, preferably the letter "R", which would stand for "ROGET", in memory of the famous man.

FIG. 1 also shows the other equipment needed to play the game. Shown are an electronic timer with alarm 55, an eight-sided die 70 and a plurality of decks of game cards 51, 52, 53, 54. Each deck of game cards 51, 52, 53, 54 has a blank top card 73, 75, 72, 71 that covers the information printed on the cards below. The shown embodiment has three decks, 51, 52, 54. Each deck is color coded and contains information that corresponds to a varying level of play. For example, the first deck 51 may contain easy questions, the second deck 52 intermediate questions, and the third deck 54 difficult questions. The fourth deck 53 shown, is a penalty/reward deck comprised of cards from the other decks 51, 52, 54.

Figure 2:
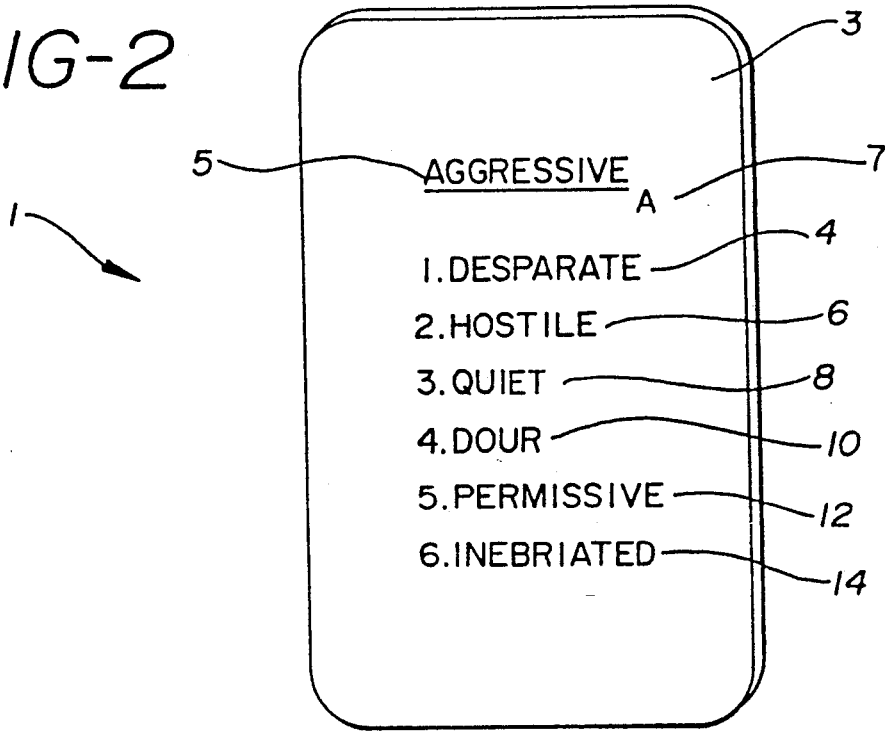
FIG. 2 shows a front view of one preferred embodiment for the playing cards of the present invention.
Figure 3:
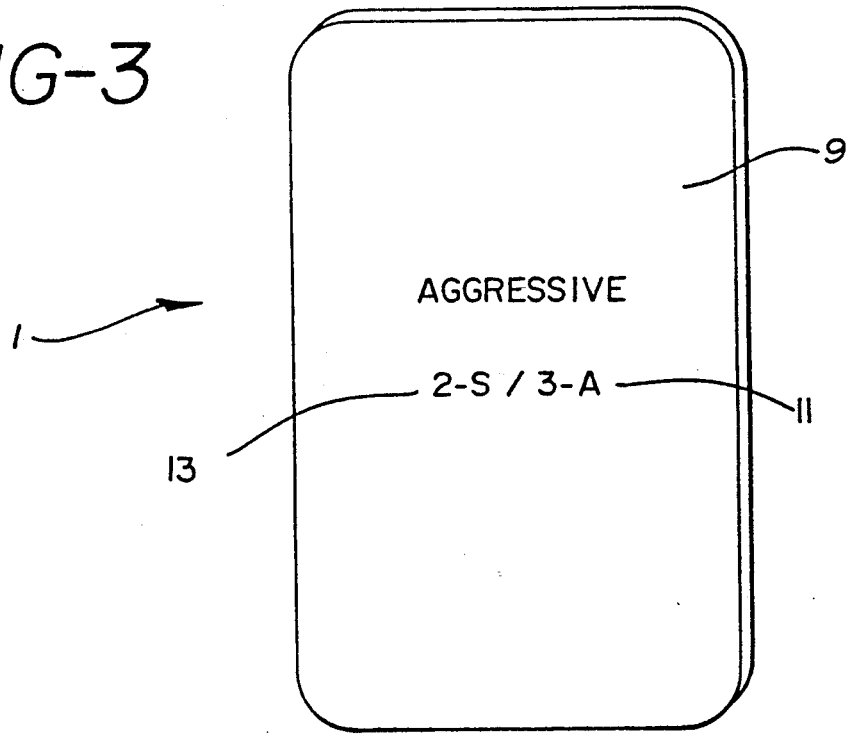
FIG. 3 shows a reverse view of the embodiment shown in FIG. 2.
Figure 4:
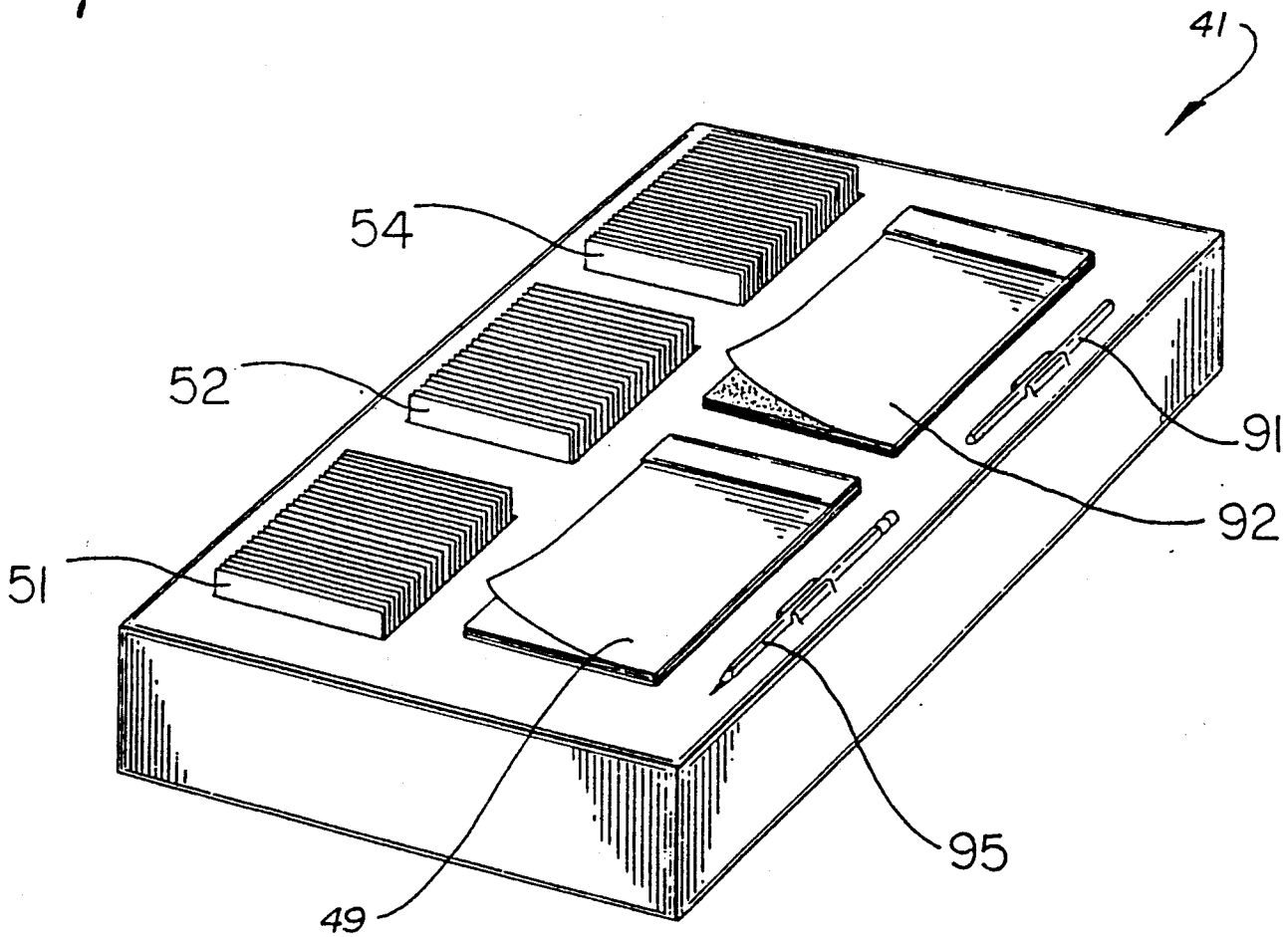
FIG. 4 shows a perspective view of one embodiment for the holding tray of the present invention in combination with card decks and the means of recording responses.

Referring to FIGS. 2 and 3, the details of the cards 1 held within the plurality of decks 51, 52, 53, 54 can be explained. The card 1 has two sides. FIG. 2 shows the front face 3, and FIG. 3 shows the reverse side 9. As is illustrated on the front face 3, there appears a keyword 5. In the present illustrated embodiment, the keyword is "AGGRESSIVE". Beside the keyword 5 is a subscript letter 7, the subscript being an "A", "N" or "V", representing the words "Adjective", "Noun" or "Verb". Below the keyword 5 and the subscript letter 7 there is a list of six subwords 4, 6, 8, 10, 12, 14 numbered 1 through 6, respectively. Within the subwords 4, 6, 8, 10, 12, 14 are either synonyms of the keywords, antonyms of the keywords, or both. On the reverse side 9, in the present embodiment of the card 1, there is printed the keyword and an answer code 13, 11, one side 13 of the code showing which numbered subword 4, 6, 8, 10, 12, 14 was a synonym and the other code 11 showing which subwords 4, 6, 8, 10, 12, 14 were antonyms. For example, in FIG. 2 the keyword 5 is "Aggressive", the subwords 4, 6, 8, 10, 12, 14 numbered 1 through 6 are potential answers. In FIG. 3 the answer 13, 11 is shown as "2-S/3-A", meaning the subword numbered 2 is a synonym and the subword numbered 3 is an antonym.

The last piece of equipment associated with the game is a carrying tray 41. The tray holds the multiple decks of cards 51, 52, 54 and holds two answer pads, the first being a paper pad 49 with pencil 95 for scorekeeping and the second being a self-cleaning pad 92 with probe 91 used to write and transfer answers.

Referring now to FIGS. 1, 2 and 3 in combination, the interaction of all the game elements can best be explained. Prior to the playing of the game, the decks of cards 51, 52, 54 are organized. The players, in deciding how far he or she wants to advance in one turn, can choose a card from either the easy, intermediate or hard deck of cards 51, 52, 54. The existence of decks of cards 51, 52, 54 have varying ability levels, allowing differently skilled players to play simultaneously. If the players of the game are of varying abilities, then a plurality of decks 51, 52, 54 can be used, each player playing from the deck 51, 52, 54 that matches his or her abilities. The decks 51, 52, 54 are then shuffled, a sampling of cards 1 are taken from each used deck to create the penalty/reward deck 53.

Each player then chooses one set of playing pieces 56, 57, 58 and places one playing piece on the start position 23. To begin play, each player may roll the eight-sided die 70 (pictured in FIG. 1) to determine who will play first. With the order determined, the first player must answer a card 1 chosen by him, or her, depending on how far they would like to advance. The player then reads aloud the keyword 5 and the six subwords 4, 6, 8, 10, 12, 14. If the player correctly matches the keyword 5 with the appropriate subwords 4, 6, 8, 10, 12, 14, then the player may advance his or her game piece. The number of spaces a player may advance is determined at the beginning of the game and is dependent upon the deck of cards 51, 52, 54 being used. For example, a correct answer from the difficult card deck may be worth 6 spaces, the intermediate deck may be worth 4 spaces, and the easy deck may be worth 2 spaces. Since each card 1 has two subwords 4, 6, 8, 10, 12, 14 that match the keyword 5, the space advancement value may be proportioned for correctly guessing both answers, or only choosing one correct answer.

Once a player selects his answers for any given card 1 and before the correct answers are revealed, the player may opt for bonus moves by stating "bonus". The answer shown on the backface 9 of a playing card 1 is then checked and, if correct, player receives an additional number of moves ("bonus moves") equal to twice the maximum number of moves attainable for correct responses. An incorrect answer will result in the loss of all points during that turn for the player, plus a penalty of retreating the number of spaces that the bonus would have been worth.

At the time a player elects to opt for bonus moves, any opponent may challenge the correctness of the responses of the player. If the challenger gives the correct answer(s) he moves his game piece forward the same number of bonus moves that the player, had he answered correctly, would have moved. A wrong answer by a challenger results in the same penalty as that for the player who guesses incorrectly.

Players may introduce as many as nine playing pieces from their playing piece set into play at one time.

Players answering properly during their turn may divide the number of bonus moves awarded them among their game pieces, advancing whatever pieces they choose. Challengers, however, are confined to advancing only one game piece for each successful challenge.

Game pieces landing on a home space 32, 33, 34, 35, 36, 37, 38, 39, 40 (shown in FIG. 1) or a safe space (space with the same color as the player) may not be disturbed by an opponent whose game piece subsequently lands on the same space for a period of a single round. In any other situation where a game piece 31 is overtaken by an opponent, the player overtaken must, on his next turn, select a card 1 from the penalty/reward deck 53. Correct responses must be given within half the pre-arranged time period normally allowed for response time, and are rewarded with the same number of moves given for typical correct responses. The overtaking opponent shall then retreat to the previous space of the same color and lose his or her next turn. If player fails to respond correctly or within the given time period, the penalty incurred in same as above.

In the effect to achieve the goal of the game, a player desiring to remain on a home space 32, 33, 34, 35, 36, 37, 38, 39, 40 permanently indicates same by placing his game piece upside down on the home space. Each playing piece has an "R" printed on its reverse side. Pieces so positioned are not subject to the penalty/reward rules outlined above but are allowed to remain positioned on the home spaces for the remainder of the game. In one embodiment of the present invention the home spaces 32, 33, 34, 35, 36, 37, 38, 39, 40 may be referred to as "ROGET" spaces throughout the game and its instructions. The first player to have a playing piece on each home space 32, 33, 34, 35, 36, 37, 38, 40 wins the game.

If in the course of play, a player is forced to retreat behind the start space 23 as a result of losing in bonus option play, the player locates his playing piece on one of the neutral spaces 27 between the last home space 32 and the start space 23. If the neutral spaces 27 prove insufficient, debit moves may continue counter-clockwise beyond the last home space 32, for as many spaces as are required. However, player may opt to permanently remain on home space 32, 33, 34, 35, 36, 37, 38, 39, 40. The individual player shall be required to use his next turn, or as many turns as may be necessary, to extricate his token from the neutral zone, and may not move any of his other tokens on the board until it is accomplished.

Play continues until a player secures each of his game pieces on a designated home space 32, 33, 34, 35, 36, 37, 38, 39, 40. In attempting to land the final playing piece on a home space, a player needs to achieve a sufficient number of points to land directly on the home space or in a differing embodiment the player needs to achieve enough points to pass the remaining home space.

In the modern world of advancing technology the above described game apparatus may be adapted for use on a personal computer. In that embodiment, keyword 5 and subwords 4, 6, 8, 10, 12, 14 could be generated from a dictionary database and both the selection of game cards and movement about a gameboard may be accomplished by screen graphics.

The game apparatus may also be modified to teach other specific concepts such as geography, spelling or foreign languages. Depending on the subject matter chosen for the game, the educational purpose behind the game may be directed at any classification of persons, including children, the handicapped or, as in the preferred embodiment describing "THESAURUS", adults.

Obviously, numerous modifications and variations of the present invention are possible in light of the above teachings. It is therefore understood that within the scope of the appended claims, the invention may be practiced otherwise than as specifically described herein.

What is claimed is:

1. A method of playing a board game with a plurality of players, which comprises:

(a) providing the following board game equipment:

(i) a game board having a plurality of distinguishable spaces creating a continuous path formed in a star-shape with ten extending points, each said point having a single distinguishable apex space, one of said apex spaces being designated as a start space and the remaining of said apex spaces being designated as home spaces, each of said home spaces having one letter printed thereon, said distinguishable spaces between any two said home spaces, each having a different color, the color pattern created by the juxtaposition of said distinguishable spaces being repeated between all of said apex spaces, except said distinguishable spaces between said start space and one said home space wherein all said spaces are the same color and are dissimilar to all other distinguishable spaces;

(ii) a plurality of sets of playing pieces, each of said playing pieces being one color and matching the color of one said distinguishable space between said home spaces on said game board, each playing piece having two sides, one side having a distinguishable indicia printed thereon;

(iii) a plurality of decks of playing cards, each of said decks being distinguishable by a unique indicia or color, each card within each of said decks having two sides, a face side that reveals a keyword, an indication as to whether the keyword is a noun, verb or adjective, and a list of subwords containing some synonyms, antonyms, or both, aforesaid keyword, and, a backside that indicates which words on said list of subwords are the synonyms or antonyms of said keyword, each said deck of playing cards created so as to correspond to a predetermined level of a player's skills;

(iv) a penalty/reward deck of cards created by shuffling a predetermined number of cards from said plurality of decks of playing cards;

(v) a timing device to limit the period in which any player must complete a turn at play; and, (vi) a set of instructions for determining the sequence and rules of play;

(b) assigning each player a set of said playing pieces;

(c) determining a sequence for players to play said board game by having repeated sequential turns for a predetermined time using said timing device;

(d) allowing the players to select their own level of difficulty at each turn;

(e) having players select and attempt to answer a keyword question from a playing card at the selected level of difficulty for each turn;

(f) upon correctly answering said keyword question, allowing players to strategically decide which playing pieces to move on said game board in accordance with points awarded and in accordance with the aforesaid instructions, and to so move such pieces; and (g) repeating turns until one player has achieved a completed game in accordance with the aforesaid instructions.

2. The game of claim 1 wherein the number of said playing pieces in each said set is one less than the number of said apex spaces on said gameboard.

3. The method of claim 1 wherein there are eight spaces between each said apex space.

4. The method of claim 1 wherein said distinguishable indicia printed on said playing pieces is the letter "R" representing the word "Roget".

5. The method of claim 1 wherein each said deck of playing cards comes with a blank cover card to cover the top card of said deck during play.

6. The method of claim 1 wherein said timing device is programmable for various time intervals, as predetermined prior to play.

7. The method of claim 1 further comprising an eight-sided die used for determining the first moves of play.

8. The method of claim 1 further comprising a paper pad and pencil for scorekeeping purposes.

9. The method of claim 8 further comprising a self-cleaning tablet with probe for the writing of answers and the quick erasure of answers between turns at play.

10. The method of claim 9 further comprising a holding tray capable of holding said plurality of decks of playing cards, said paper paid, said pencil, said self-cleaning tablet and said probe, for the quick and efficient passage of materials between players.

11. The method of claim 1 wherein the letters printed on each home space of said game board spell the word T-H-E-S-A-U-R-U-S.

* * * * *